US005707945A

United States Patent [19]

Cooban et al.

[11] Patent Number: 5,707,945

[45] Date of Patent: Jan. 13, 1998

[54] BASE FLUIDS

[75] Inventors: Nigel Andrew John Cooban, Wallasey Whirrall, Great Britain; Hendrik Leendert Rieffe, Gouda, Netherlands

[73] Assignee: Unichema Chemie B. V., Gouda, Netherlands

[21] Appl. No.: 612,897

[22] PCT Filed: Sep. 8, 1994

[86] PCT No.: PCT/EP94/03004

§ 371 Date: Mar. 5, 1996

§ 102(e) Date: Mar. 5, 1996

[87] PCT Pub. No.: WO95/07961

PCT Pub. Date: Mar. 23, 1995

[30] Foreign Application Priority Data

Sep. 14, 1993 [EP] European Pat. Off. ..... 93202655

[51] Int. Cl.[6] ..... C10M 105/36; C10M 107/34

[52] U.S. Cl. ..... 508/497; 72/42; 252/79

[58] Field of Search ..... 508/497

[56] References Cited

U.S. PATENT DOCUMENTS

| | | | |
|---|---|---|---|
| 2,758,976 | 8/1956 | Baker | 252/79 |
| 3,485,754 | 12/1969 | Boylan et al. | 252/56 S |
| 3,623,987 | 11/1971 | Ker et al. | 508/497 |
| 3,893,931 | 7/1975 | Sturwold | 252/49.5 |
| 3,914,182 | 10/1975 | Ker et al. | 508/497 |
| 3,939,088 | 2/1976 | Goldschmidt et al. | 508/497 |
| 4,731,190 | 3/1988 | O'Lenick, Jr. et al. | 252/56 S |
| 4,784,784 | 11/1988 | Dohner | 508/497 |
| 4,830,769 | 5/1989 | O'Lenick, Jr. et al. | 252/56 S |
| 5,360,560 | 11/1994 | Schmid et al. | 252/56 S |

FOREIGN PATENT DOCUMENTS

| | | |
|---|---|---|
| 2-41392 | 2/1990 | Japan . |
| 3-33192 | 2/1991 | Japan . |
| 1 237 748 | 6/1971 | United Kingdom . |
| 88 05809 | 8/1988 | WIPO . |

OTHER PUBLICATIONS

Database WPI, Week 9012, Derwent Publications Ltd., London, GB.

*Primary Examiner*—Ellen M. McAvoy
*Attorney, Agent, or Firm*—Cushman Darby & Cushman IP Group Pillsbury Madison & Sutro LLP

[57] ABSTRACT

A base fluid for hydraulic or metal working fluids comprises the esterification product having a hydroxyl number below 15 and an acid number below 10 of polymerized fatty acids and a monohydric alkoxylated alcohol, selected from (a) straight or branched chain saturated monohydric $C_1$–$C_{24}$ alcohols, alkoxylated with 2–25 moles of $C_2$–$C_5$ alkylene oxide and (b) alkoxy poly(alkylene) glycol etherified with $C_1$–$C_4$ aliphatic monohydric alcohol and which is alkoxylated with 2–25 moles of $C_2$–$C_5$ alkylene oxide, optionally the alcohol component also comprises (c) a straight or branched chain $C_1$–$C_{24}$ aliphatic monohydric alcohol. The acid number of the crude ester is preferably reduced by reacting it with a glycidyl ester of a $C_5$–$C_{22}$ aliphatic monocarboxylic acid, preferably a $C_6$–$C_{12}$ branched chain, aliphatic monocarboxylic acid.

15 Claims, No Drawings

BASE FLUIDS

This application claims benefit of international application PCT/EP94/03004, filed Sep. 8, 1994, now WO95/07961.

1. Field of Invention

The present invention relates to a base fluid for hydraulic or metal working fluids comprising an effective amount of a specific esterification product. By "hydraulic fluid" is understood throughout this specification and the attached claims fluids which are used in hydraulic machinery, such as brake mechanisms, shock absorbers, automatic transmission of motor vehicles, control mechanisms and similarly operated hydraulic mechanisms. These hydraulic fluids may also be in the form of water and oil emulsions.

By "metal working fluid" is understood throughout this specification and the attached claims fluids which are used in machining and working operations of in particular (but not exclusively) metals, such as turning, milling, drilling, grinding, punching, deep drawing and the like operations. These metal working fluids may also be in the form of water and oil emulsions.

2. Background of Invention

Base fluids for hydraulic fluids should meet various requirements, such as good lubricity, good compatability with other commercially available hydraulic fluids, very little swelling effect on (synthetic) rubber, not agressive towards metals, a high boiling or flash point, a freezing point which is as low as possible, environmentally safe (preferably biodegradable) and it should neither in vapour form nor in liquid form have a detrimental effect on the health. It will be clear that such a variety of requirements, which sometimes may even be conflicting, is very difficult to meet.

In the past base fluids on the basis of poly(alkylene) glycols have been proposed for hydraulic fluids, but these are hygroscopic and due to the water absorption from the environment, the flash point is lowered. It has also been proposed in U.S. Patent Specification U.S. Pat. No. 2,755,251 (Atlas Powder Comp.) to formulate a hydraulic fluid using $C_3$–$C_{10}$ aliphatic glycols, $C_4$–$C_8$ monoalkyl glycol ethers and a reaction product of linoleic dimer acid and 20–35 moles of propylene oxide as the base fluid, but these products are still hygroscopic.

In German Patent Application DE-A-2,426,925 (Institut Francais du Pétrole) there has been described the addition of 10–40 wt % of an ester of dimer or trimer acid with a mixture of 15–99% mole of a monohydroxy ether from the condensate of 2–50 moles of a $C_2$–$C_5$ alkylene oxide with a $C_1$–$C_{25}$ aliphatic monohydric alcohol and 85–1 mole % of an aliphatic $C_1$–$C_{25}$ monohydric alcohol, to a solvent refined paraffinic lubrication oil. These complex esters are stated to improve the viscosimetric properties of the lubrication oil, so that its incorporation therein enables the manufacture of general purpose motor oils.

Further such metal working fluids have been disclosed in American Patent Specification U.S. Pat. No. 4,172,802 (Cincinnati Milacron Inc.) in which metal working fluid compositions have been described, comprising water and a carboxylic acid group terminated diester of dimerized or trimerized $C_8$–$C_{26}$ unsaturated fatty acids and a polyoxyalkylene diol having two terminal secondary alcohol groups, or the alkali metal salt or organic amine salt of said diester.

SUMMARY OF INVENTION

It has now been found that the esterification product of polymerized unsaturated $C_{12}$–$C_{24}$ fatty acids with a monohydric alkoxylated alcohol, optionally in admixture with a saturated monohydric alcohol, is an excellent base fluid for hydraulic fluids or metal working fluids and can be used as such or in effective amounts in conventional hydraulic fluids or metal working fluids, which can also be in the form of an oil and water emulsion.

Therefore, the present invention relates to a base fluid for hydraulic or metal working fluids comprising the esterification product, having an acid number below 10 and a hydroxyl number below 15, obtained by esterification of:

(a) polymerized unsaturated $C_{12}$–$C_{24}$ fatty acid, selected from the group consisting of dimer acid, trimer acid, hydrogenated dimer acid, hydrogenated primer acid, and mixtures thereof, and (b) a monohydric alkoxylated alcohol selected from the group consisting of:

(1) straight or branched chain, saturated monohydric alcohols having from 1 to 24 carbon atoms which are alkoxylated with from 2 to 25 moles of a $C_2$–$C_5$ alkylene oxide, and (2) alkoxy poly (alkylene) glycols in which one of the two terminal hydroxyl groups is etherified with a $C_1$–$C_4$ aliphatic monohydric alcohol and which is alkoxylated with from 2 to 25 moles of a $C_2$–$C_5$ alkylene oxide, and optionally (c) a straight or branched chain, saturated monohydric alcohol having from 1 to 24 carbon atoms.

DETAILED DESCRIPTION OF INVENTION

The acid number of the esterification product is preferably reduced to the required value by reacting the esterification product with a glycidyl ester as described in British Patent Specification GB-A-1,237,748. The polymerized unsaturated $C_{12}$–$C_{24}$ fatty acids are selected from the group consisting of dimer acid (such as Pripol 1013, 1017 or 1022 (Trade Mark) ex Unichema Chemie BV, Gouda, The Netherlands), trimer acid, hydrogenated dimer acid (such as Pripol 1009 or 1025 (Trade Mark) ex Unichema Chemie BV, Gouda, The Netherlands), hydrogenated trimer acid and mixtures thereof. If need be the dimer and trimer acids may be distilled prior to or after their hydrogenation. The use of trimer acid (such as Pripol 1040 (Trade Mark) ex Unichema Chemie BV, Gouda, The Netherlands), is preferred.

The monohydric alkoxylated alcohol may be selected from the group consisting of:

(1) straight or branched chain saturated monohydric alcohols having from 1 to 24 carbon atoms, which are alkoxylated with from 2 to 25 moles, preferably from 6 to 12 moles of a $C_2$–$C_5$ alkylene oxide, such as ethylene oxide, propylene oxide, butylene oxide, and mixtures of these alkylene oxides. Preferably the average molecular weight is from 200 to 2000, most preferably from 300 to 1000. The monohydric alcohols may for example be methanol, iso-propanol, octanol, decyl alcohol, iso-octyl alcohol and the like. Also mixtures of alcohols may be used, such as for example Synprol alcohol (Trade Mark; a saturated synthetic primary alcohol mixture ex ICI PLC, UK, obtained by hydro-formylation of linear alpha-olefins) and also Synprol 91 (Trade Mark; a saturated synthetic primary alcohol mixture, ex ICI PLC, UK).

(2) alkoxy poly (alkylene) glycols in which one of the two terminal hydroxyl groups is "capped" or etherified with a $C_1$–$C_4$ aliphatic monohydric alcohol, such as methanol or butanol, and which comprises from 2 to 25 moles, preferably from 6 to 12 moles of a $C_2$–$C_5$ alkylene oxide, such as ethylene oxide, propylene oxide, butylene oxide and mixtures of these alkoxides.

Preferably the average molecular weight is from 200 to 2000, most preferably from 300 to 1000.

Optionally, the alcohol component in the esterification reaction is a mixture of component (b) and a second component (c), which is a straight or branched chain, saturated monohydric alcohol having from 1 to 24, preferably from 1 to 14 carbon atoms. Examples of such alcohols are methanol, butanol, isopropanol, iso-octanol, lauryl alcohol, and mixtures of these alcohols.

The esterification product has an acid number of at most 10, preferably at most 5 and most preferably less than 1, and a hydroxyl number of at most 15, preferably at most 10. The acid number of the crude esterification product is preferably adjusted to the required value of less than 10, preferably less than 5, by reacting the esterification product with a glycidyl ester of an aliphatic monocarboxylic acid containing 5 to 22 carbon atoms, as described in British Patent Specification GB-A-1,237,748 (Unilever-Emery N.V.). A suitable glycidyl ester is for example Cardura E 10 (Trade Mark; the glycidyl ester of a synthetic saturated monocarboxylic acid mixture of highly branched $C_{10}$-isomers, ex Shell Resins, The Netherlands). If the esterification products are made by interesterification then usually no treatment with a glycidyl ester is required.

When used in a conventional hydraulic fluid the esterification product can be used in an amount of from 10% by weight to 95% by weight, preferably from 20% by weight to 75% by weight, based on the total hydraulic fluid. The amount to be used will amongst others be determined by the required viscosity of the hydraulic fluid .

The hydraulic fluid may also comprise functional additives, such as metal passivators, like benztriazole, corrosion inhibitors, like phenyl alpha-naphthylamine, anti-oxidants such as those of the phenolic type, additives for the improvement of high pressure properties, anti-wear additives such as zinc dialkylthiophosphates, thickening or bodying agents, antifoam agents such as silicone polymers, emulsifiers, detergents or dispersing agents, pour point depressors such as polymethacrylates, viscosity index improvers such as polymethacrylates or vinyl pyrrolidone/methacrylate copolymers, colouring agents and mixtures of any one or more of these functional additives.

When used as a base fluid in a conventional metal working fluid the final ester can be used in an amount of from 5 by weight to 95% by weight, preferably from 20% by weight to 70% by weight, based on the total metal working fluid concentrate. The metal working fluid concentrate is usually converted into a water and oil emulsion by diluting the concentrate with water, preferably in such proportions that the emulsion contains from 1% to 10% by weight of the concentrate.

The base fluid for the metal working fluid may also comprise functional additives, such as metal passivators, like benztriazole, corrosion inhibitors, like phenyl alpha-naphthylamine, anti-oxidants such as those of the phenolic type, biocides, antifoam agents such as silicone polymers, emulsifiers, detergents or dispersing agents, fungicides, bacteriocides, colouring agents and mixtures of any one or more of these functional additives.

The invention will now be illustrated by the following examples.

EXAMPLE I

A 4 liter five-necked reaction vessel, equipped with a thermometer, a water cooler, mechanical stirrer, inlet and tube for inert gas and an inlet tube for isopropanol, connected with a mechanical pump and a 2.5 liter flask filled with isopropanol, was charged with 1500 gram (2.60 moles) of dimer acid and 1.5 gram (0.011 moles) of tin (II)oxide as catalyst. The dimer acid and catalyst were heated to 230° C. under a constant nitrogen flow. When the temperature reached 180° C., the introduction of isopropanol was started. Reaction water and unreacted isopropanol were distilled off. After approximately 4 hours an acid value of 100 mg KOH gram was raeched and the introduction of isopropanol was then stopped. The reaction was cooled below 100° C. and 1562 gram (2.84 moles) Breox methoxy polyethylene glycol-550 (Trade Mark; a methoxy polyethylene glycol ex BP Chemicals, UK having an average molecular weight of 525–575; density 1.1 $g.cm^{-3}$; freezing point 20° C. and viscosity of 7.5 $mm^2$/sec at 100° C.) was added to the reaction mixture. The reaction mixture was heated again to 250° C. under a constant nitrogen flow and reaction water was distilled off. After the acid value has fallen below 15 mg KOH/gram the reaction was proceeded at 250° C. and reduced pressure (approximately 1000 Pa) for 4 hours. The raw material was a brown liquid with an acid value of 5 mg KOH/gram. After cooling to 100° C., 100 grams of Cardura E-10 (referred to herebefore) was added to the reaction mixture, which was subsequently heated to 225° C. for 1 hour. The excess Cardura E-10 was distilled off at 250° C. and 1000 Pa. The obtained reaction product was a brown liquid with a hydroxyl number of 8, an acid number of less than 1 and a viscosity index of 188.

EXAMPLE II

A 4 liter five-necked reaction vessel equipped with a thermometer, a water cooler, mechanical stirrer in and outlet tubes for inert gas and an inlet tube for isopropanol, connected with a mechanical pump and a 2.5 liter flask filled with isopropanol, was charged with 1426 gram (2.47 moles) of dimer acid and 863.5 gram (2.47 moles) of Breox methoxy polyethylene glycol 350 (Trade Mark; a methoxy polyethylene glycol ex BP Chemicals, UK; having an average molecular weight of 335–365; a density of 1.09 $g.cm^{-3}$; a freezing point of 5° C. and a viscosity at 100° C. of 4.1 $mm^2$/sec). The reaction mixture was heated to 250° C. under a constant nitrogen flow, the reaction water being removed by distillation. After approximately 3 hours the acid value had reached a value of 60 mg KOH/gram and hardly no reaction water was distilled off any more.

The mixture was cooled to 230° C. and 2.6 grams (0.019 moles) of tin (II)oxide as catalyst were added to the reaction mixture and the introduction of isopropanol was started. The reaction was proceeded under constant introduction of isopropanol and a nitrogen flow at 230° C., reaction water and unreacted isopropanol being distilled off. After 8 hours an acid value was reached of 5 mg KOH/gram. The reaction was then stopped, the obtained raw material was a brown coloured liquid. After treatment with Cardura E-10 as described in Example I the product had a hydroxyl number and an acid number below 1, the viscosity index was 176.

The product obtained in Example II was tested in a tribometer by means of a fixed steel ball which was pressed against a rotating steel ring. The load by which the ball is pressed against the ring and the rotation speed of the ring are variable. The ball/ring contact was immersed in the product to be tested. With this apparatus the transition of various different lubricant modes can be tested. One can distinguish three different lubricant modes:

Region I: the characteristics are no wear and low friction coefficient.

Region II: Boundary region. The load is carried by both the lubricant film and the metal surfaces. There is limited wear and an initial high friction coefficient followed by a low friction coefficient.

Region III: Dry friction. There is no lubricant between the metal surfaces and there is high wear and a high friction coefficient.

The product of Example II was tested at a ring speed of 0.5 m/s and 2.0 m/s and trimethylolpropane trioleate (TMPTO) was used as a reference substance. The results are summarized below.

| | Speed M/S | Example II product | Example II product + 5 wt % water | TMPTO |
|---|---|---|---|---|
| Transition I II at N | 0.5 | 525 | 575 | 475 |
| Transition II III at N | 0.5 | 1150 | 1450 | 1050 |
| Transition I III at N | 2.0 | 275 | 125 | 225 |

The lubricity behaviour of the product of Example II is better than that of TMPTO under the conditions tested. At high speed the transition from region I to region III occurs at much lower loads.

EXAMPLE III

A 2 liter four-necked reaction vessel equipped with a mechanical stirrer, a thermometer, a water cooler and an inlet for inert gas was charged with 816, 1 gram (2.33 moles) of methoxy ethylene glycol 350 (the same product as in Example II) and 683,9 gram (0.78 moles) of trimer acid. The reaction mixture being distilled off. After the acid value had fallen below 15 mg KOH/gram, the reaction was proceeded at 250° C. and reduced pressure (approximately 1000 Pa) for 4 hours. The crude product was a brown viscous oil with an acid value of 5 mg KOH/gram. After treatment with 50 grams of Cardura E-10 as described in Example I, the hydroxyl number was 14 and the acid number less than 1, the viscosity index 195.

EXAMPLE IV

A 2 liter four-necked reaction vessel equipped with a mechanical stirrer, a thermometer, a water cooler and an inlet for inert gas was charged with 1020.4 gram (1.64 moles) of Synperonic 91/12 (Trade Mark; an ethoxylated fully saturated synthetic primary alcohol produced by hydroformylation of $C_8/C_{10}$ linear alpha-olefines having 12 ethylene oxide groups, a pour point of 26° C., viscosity 30 centipoise and density 1.013 $g.cm^{-3}$, ex ICI PLC, United Kingdom) and 479,6 gram (0,55 moles) of trimer acid. The reaction mixture was heated to 250° C. under a constant nitrogen flow, the reaction water was distilled off. After the acid value had fallen below 15 mg KOH/gram, the reaction was proceeded at 250° C. and reduced pressure (approximately 1000 Pa) for 4 hours. The crude product was a brown viscous oil with an acid value of 5 mg KOH/gram. After treatment with 50 grams of Cardura E-10 described in Example I, the hydroxyl number was 12 and the acid number less than 1, whereas the viscosity index was 210.

EXAMPLE V

A 2 liter four-necked reaction vesel equipped with a mechanical stirrer, a thermometer, a water cooler and an inlet for inert gas was charged with 412,7 gram (1,18 moles) of methoxy ethylene glycol 350 (the same product as used in Example II), 1087,3 gram (1,18 moles) of trimethyl trimerate and 27,0 gram 30% (w/w) of sodium methanolate in methanol (0,15 moles active). The reaction mixture was heated to 150° C. under a constant nitrogen flow, the methanol being distilled off. After the hydroxyl value had fallen below 10 mg KOH/gram the reaction was proceeded at 150° C. and reduced pressure (approximately 1000 Pa), for 4 hours. The product was a brown viscous oil with a hydroxyl number of 2 an acid number below 1 and a viscosity index of 173.

We claim:

1. A hydraulic fluid comprising a base fluid and one or more functional additives, characterized in that the hydraulic fluid comprises, based on total hydraulic fluid, from 10% by weight to 95% by weight of a base fluid comprising an esterification product, having an acid number below 10 and a hydroxyl number below 15, obtained by esterification of:

(a) a polymerized unsaturated $C_{12}$–$C_{24}$ fatty acid selected from the group consisting of dimer acid, trimer acid, hydrogenated dimer acid, hydrogenated trimer acid, and mixtures thereof; and (b) a monohydric alkoxylated alcohol selected from the group consisting of:

(1) straight or branched chain, saturated monohydric alcohols having from 1 to 24 carbon atoms, which are alkoxylated with from 6 to 12 moles of a $C_2$–$C_5$ alkylene oxide, and (2) alkoxy poly(alkylene) glycols in which one of the two terminal hydroxyl groups is etherified with a $C_1$–$C_4$ aliphatic monohydric alcohol and which is alkoxylated with from 6 to 12 moles of a $C_2$–$C_5$ alkylene oxide, and optionally, (c) a straight or branched chain, saturated monohydric alcohol having from 1 to 24 carbon atoms, until the acid number of the ester is below 10 and the hydroxyl number is below 15.

2. A hydraulic fluid according to claim 1 in which (b) of the base fluid has an average molecular weight of 200 to 2000.

3. A hydraulic fluid according to claim 2 in which (b) of the base fluid has an average molecular weight to 300 to 1000.

4. A hydraulic fluid according to claim 1 in which (c) in the base fluid comprises from 1 to 14 carbon atoms.

5. A hydraulic fluid according to claim 1 in which the esterification product of the base fluid has an acid number of at most 5 and a hydroxyl number of at most 10.

6. A hydraulic fluid according to claim 1 in which the esterification product of the base fluid has an acid number of less than 1.

7. A hydraulic fluid according to claim 1, comprising from 20% to 75% by weight of the base fluid.

8. A metal working concentrate which comprises, based on total metal working concentrate, from 5% by weight to 95% by weight of a base fluid comprising an esterification product, having an acid number below 10 and a hydroxyl number below 15, obtained by esterification of:

(a) a polymerized unsaturated $C_{12}$–$C_{24}$ fatty acid selected from the group consisting of dimer acid, trimer acid, hydrogenated dimer acid, hydrogenated trimer acid, and mixtures thereof; and (a) a monohydric alkoxylated alcohol selected from the group consisting of:

(1) straight or branched chain, saturated monohydric alcohols having from 1 to 24 carbon atoms, which are alkoxylated with from 6 to 12 moles of a $C_2$–$C_5$ alkylene oxide, and (2) alkoxy poly(alkylene) glycols in which one of the two terminal hydroxyl groups is etherified with a $C_1$–$C_4$ aliphatic monohydric alcohol and which is alkoxylated with from 6 to 12 moles of a $C_2$–$C_5$ alkylene oxide, and optionally, (c) a straight or branched chain, saturated monohydric alcohol having from 1 to 24 carbon atoms, until the acid number of the ester is below 10 and the hydroxyl number is below 15.

9. A metal working fluid according to claim 8 in which (b) of the base fluid has an average molecular weight of 200 to 2000.

10. A metal working fluid according to claim 9 in which (b) of the base fluid has an average molecular weight of 300 to 1000.

11. A hydraulic fluid according to claim 8 in which (c) in the base fluid comprises from 1 to 14 carbon atoms.

12. A hydraulic fluid according to claim 8 in which the esterification product of the base fluid has an acid number of at most 5 and a hydroxyl number of at most 10.

13. A hydraulic fluid according to claim 8 in which the esterification product of the base fluid has an acid number of less than 1.

14. A hydraulic fluid according to claim 8 which comprises from 20% by weight to 70% by weight of the base fluid.

15. A metal working water and oil emulsion which comprises from 1% to 10% by weight of the metal working concentrate of claim 8.

* * * * *